US011328923B2

(12) United States Patent
Fujisawa et al.

(10) Patent No.: US 11,328,923 B2
(45) Date of Patent: May 10, 2022

(54) EXCIMER LAMP

(71) Applicant: Ushio Denki Kabushiki Kaisha, Tokyo (JP)

(72) Inventors: Shigeki Fujisawa, Tokyo (JP); Kazuyuki Mori, Tokyo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/257,268

(22) PCT Filed: Jun. 26, 2019

(86) PCT No.: PCT/JP2019/025322
§ 371 (c)(1),
(2) Date: Dec. 30, 2020

(87) PCT Pub. No.: WO2020/008971
PCT Pub. Date: Jan. 9, 2020

(65) Prior Publication Data

US 2021/0272792 A1 Sep. 2, 2021

(30) Foreign Application Priority Data

Jul. 6, 2018 (JP) ..... JP2018-129309

(51) Int. Cl.
*H01J 61/067* (2006.01)
*H01J 65/00* (2006.01)
(Continued)

(52) U.S. Cl.
CPC ..... *H01J 65/00* (2013.01); *H01J 61/12* (2013.01); *H01J 61/302* (2013.01);
(Continued)

(58) Field of Classification Search
CPC ..... H01J 65/00; H01J 61/305; H01J 61/33; H01J 61/368
See application file for complete search history.

(56) References Cited

U.S. PATENT DOCUMENTS

2011/0156581 A1* 6/2011 Yasuda ..... H01J 61/34 313/572

FOREIGN PATENT DOCUMENTS

JP 2003317665 A * 11/2003 ..... H01J 65/00
JP 2003317665 A 11/2003
(Continued)

OTHER PUBLICATIONS

International Search Report issued in PCT/JP2019/025322; dated Sep. 24, 2019.
(Continued)

*Primary Examiner* — Donald L Raleigh
(74) *Attorney, Agent, or Firm* — Studebaker & Brackett PC

(57) ABSTRACT

In the excimer lamp according to the present invention, a flat discharge vessel having a substantially rectangular cross-sectional shape and comprising a pair of planar parts and a pair of side-surface parts has a pair of external electrodes disposed on the respective outer surfaces of the planar parts. The end parts of the external electrodes are provided with an auxiliary electrode extending to a region that is made smaller than the distance between the planar parts. A lead that supplies electricity to the external electrode is connected to the auxiliary electrode in the region that is made smaller than the distance between the planar parts.

3 Claims, 7 Drawing Sheets

(51) Int. Cl.

| | |
|---|---|
| ***H01J 61/12*** | (2006.01) |
| ***H01J 61/30*** | (2006.01) |
| ***H01J 61/33*** | (2006.01) |
| ***H01J 61/36*** | (2006.01) |

(52) U.S. Cl.
CPC ..... *H01J 61/305* (2013.01); *H01J 61/33* (2013.01); *H01J 61/368* (2013.01)

(56) References Cited

FOREIGN PATENT DOCUMENTS

| | | | | |
|---|---|---|---|---|
| JP | 2013098015 | A | 5/2013 | |
| JP | 2013149546 | A | 8/2013 | |
| WO | WO-2009113449 | A1 * | 9/2009 | ..... H01J 61/16 |

OTHER PUBLICATIONS

Notification of Transmittal of Translation of the International Preliminary Report on Patentability and Translation of Written Opinion of the International Searching Authority; PCT/JP2019/025322 ; dated Jan. 21, 2021.

* cited by examiner

EXCIMER LAMP

TECHNICAL FIELD

This invention relates to an excimer lamp with a discharge vessel having a flat quadrilateral cross section, and more particularly to an excimer lamp provided with electrodes on outer surfaces of the discharge vessel.

BACKGROUND ART

Excimer lamps can radiate ultraviolet, in particular, ultraviolet having shorter wavelengths and are therefore used in semiconductor production processes, liquid crystal production processes, ozone generators, and so on.

One example of such excimer lamps is described in JP-A-2013-098015 (Patent Document 1).

Such an excimer lamp 21 is illustrated in FIG. 5. A discharge vessel 22 has a flat quadrilateral cross section as a whole. External electrodes 24 are provided on opposite outer surfaces of plane face parts 23 of the discharge vessel 22, and these external electrodes 24 are connected to a high-frequency power supply (not shown).

For this discharge vessel 22, for example, a material having excellent UV transmission characteristics of 200 nm or less, for example, silica glass such as synthetic quartz glass or sapphire glass is used.

The discharge vessel 22 contains therein as a light emitting gas a rare gas such as xenon gas or krypton gas, or a mixed gas containing a rare gas and a halogen gas such as chloride, depending on the wavelength of the light to be used.

Lamp bases 30, 30 are attached to both ends of the discharge vessel 22 for fixing the excimer lamp 21 to a light irradiation device.

The structure of this excimer lamp 21 is shown in JP-A-2013-149546 (Patent Document 2), for example, and FIG. 6 illustrates the specific structure of this excimer lamp 21.

A discharge vessel 22 includes a glass tube 221 having a flat quadrilateral cross section, and a sealing member 222 inserted and welded to both ends of the glass tube.

An exhaust tube 223 is provided to the sealing member 222. The sealing member 222 is inserted slightly inward from an end portion of the glass tube 221 so that the end portion of the glass tube 221 forms a skirt part 224 that protrudes out beyond the sealing member 222.

In the prior art described in Patent Document 2, a solid electrode 25 is provided at an end portion of an external electrode 24, and a lead 26 that supplies power to the external electrode 24 is connected to this solid electrode 25 by welding with glass solder 27 or the like.

The lamp base 30 is attached so as to cover an end portion of the discharge vessel 22 as illustrated in FIG. 6(B).

These excimer lamps are used for various purposes as mentioned above; however, an excimer lamp that is applied for the process of a flowing gas, for example an ozone generator, is disposed such that its lengthwise direction is along the flow direction of a gas to be processed, and the lamp irradiates the gas with vacuum ultraviolet.

In such a case, there is a problem as follows: the gas to be processed forms eddies in behind (downstream of) the lamp base 30 as illustrated in FIG. 7, a turbulent flow is generated in the gas, so that a smooth flow along the discharge vessel 22 of the excimer lamp 21 cannot be formed and an efficient process cannot be performed.

The lead 26 for power supply is connected by welding with the glass solder 27 on the (solid electrode 25 of the) external electrode 24 as illustrated in FIG. 6, and the weld portion (solder) 27 protrudes from the outer surface in the thickness direction of the discharge vessel 22 (thickness direction between the external electrodes). This makes the thickness of the lamp base 30 be much larger than that of the discharge vessel 22, which furthermore causes a defect.

Vacuum ultraviolet emitted from the excimer lamp travels a short distance in a gas, and attenuates as it is absorbed by the surrounding gas. Even in cases where the excimer lamp is used as the light source for directly irradiating an object to be processed other than gasses to be processed with vacuum ultraviolet, the lamp base has a significantly larger thickness than that of the lamp. Accordingly, the excimer lamp cannot be disposed closely to the object to be processed, and such a situation causes a defect such that effective ultraviolet irradiation cannot be performed.

PRIOR ART DOCUMENT

Patent Documents

Patent Document 1: JP-A-2013-098015
Patent Document 2: JP-A-2013-149546

SUMMARY OF THE INVENTION

Problems to be Solved by the Invention

In view of the problems in the prior art described above, an object of the present invention is to provide an excimer lamp including a discharge vessel including a pair of plane face parts and a pair of side face parts and having a flat, substantially quadrilateral cross section, and a pair of external electrodes each disposed on each of outer surfaces of the plane face parts of the discharge vessel. The excimer lamp whose lamp base provided at an end portion of the discharge vessel has a minimum possible thickness to enable effective ultraviolet irradiation of an object to be processed; and the excimer lamp is suitable for a device in which a gas is made to flow along the longitudinal direction of the lamp to be processed.

Means for Solving the Problems

To attain the object described above, the invention is characterized in that an auxiliary electrode that extends to a region where a distance between the plane face parts is reduced is provided to an end portion of each of the external electrodes, and a lead that supplies power to the external electrode is connected to the auxiliary electrode in the region where a distance between the plane face parts is reduced.

The invention may be also characterized in that the discharge vessel includes a glass tube having a flat, substantially quadrilateral cross section, and sealing members each welded to near an end portion of the glass tube, the end portion of the glass tube protrudes out beyond the sealing member to form a skirt part. The skirt part has a concave part formed on each of the plane face parts thereof in a direction in which the external electrodes are oriented oppositely, the auxiliary electrode extends to the concave part, and the lead is connected to the auxiliary electrode in the concave part.

The invention may be also characterized in that the discharge vessel is sealed by forming a pinch seal part in an end portion of the discharge vessel, the auxiliary electrode extends to the pinch seal part, and the lead is connected to the auxiliary electrode at the pinch seal part.

Effect of the Invention

According to the present invention, an auxiliary electrode is provided to an end portion of the external electrode, and a lead that supplies power to the external electrode is connected to the auxiliary electrode in a region where the distance between the external electrodes is reduced. Therefore, the lead and its weld do not protrude from the plane face part largely in the thickness direction, which prevents the lamp base that covers the lead and weld from protruding more than the thickness of the discharge vessel as much as possible. Accordingly, the flow of the gas to be processed is not hindered and can flow smoothly along the discharge vessel of the lamp, thus enabling an effective process.

In cases where an object to be processed other than gasses is directly irradiated with ultraviolet, the lamp can be disposed in close vicinity to the object to be processed, which is expected to reduce attenuation of vacuum ultraviolet caused by the air to enable an effective process.

MODE FOR CARRYING OUT THE INVENTION

Figure 1:
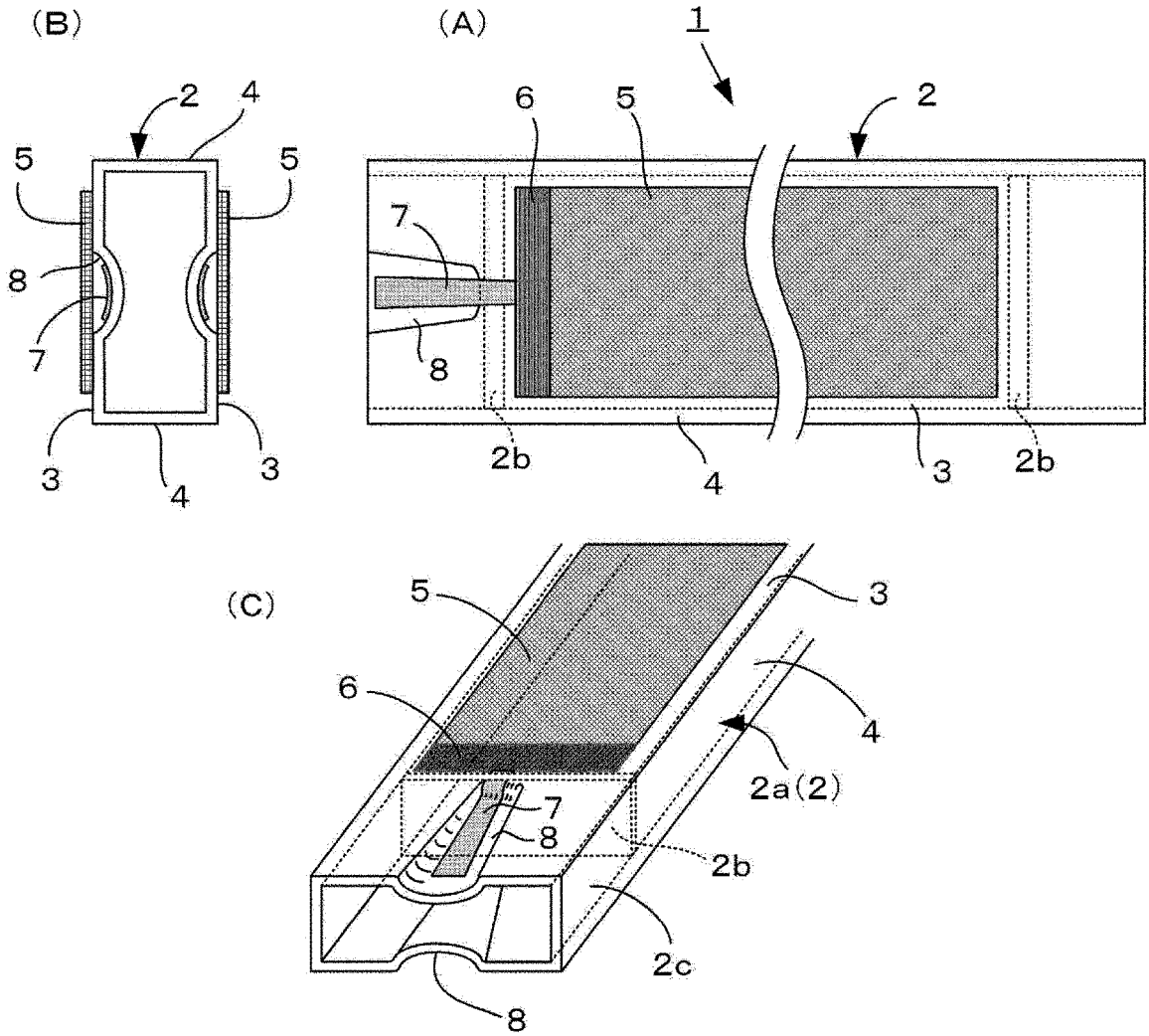
FIG. 1 is top plan view (A), a side view (B), and a perspective view (C) of a first embodiment of the present invention.
Figure 2:
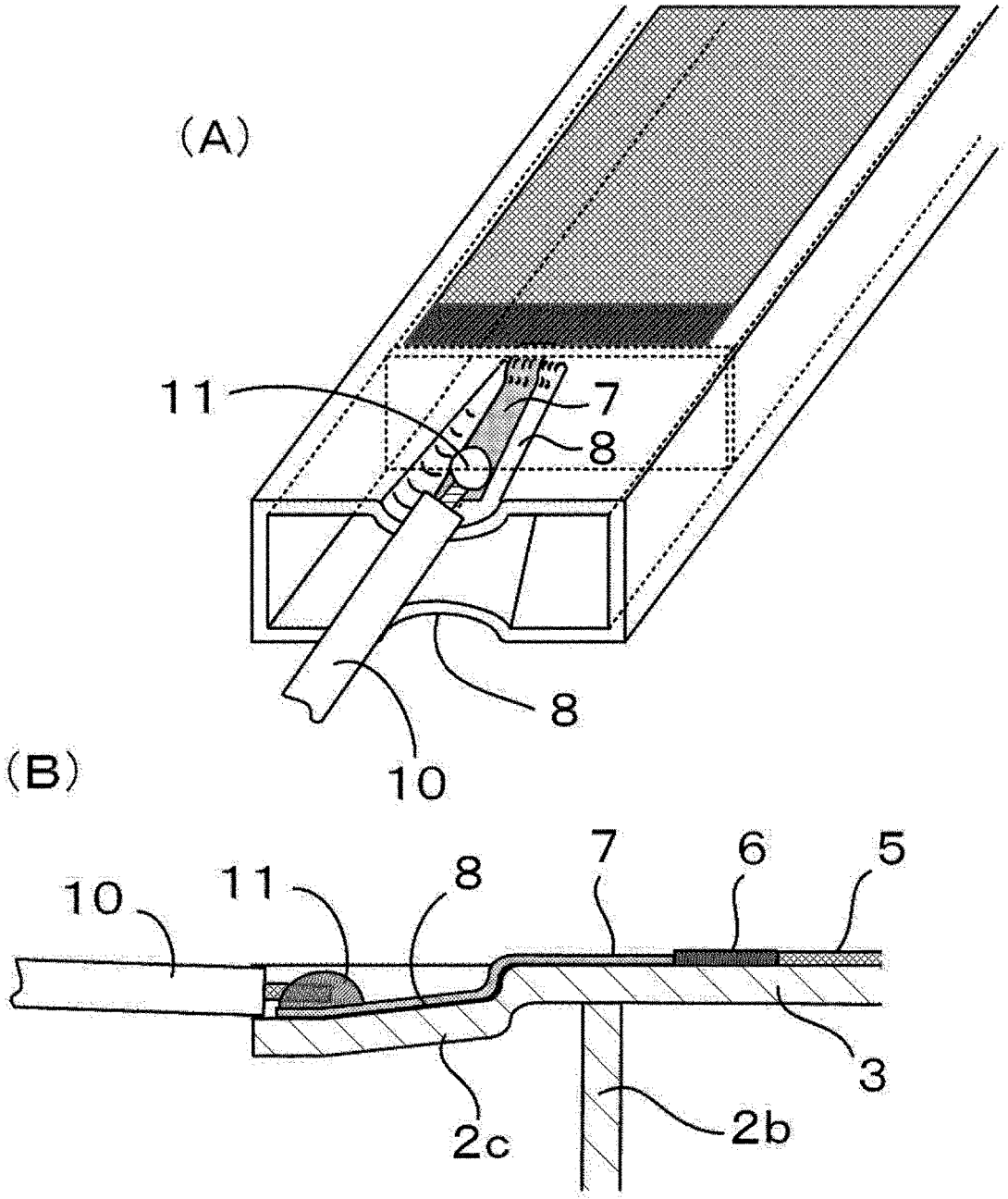
FIG. 2 is a perspective part (A) and a partially cross-sectional side view (B) of a state where a lead is connected.
Figure 6:
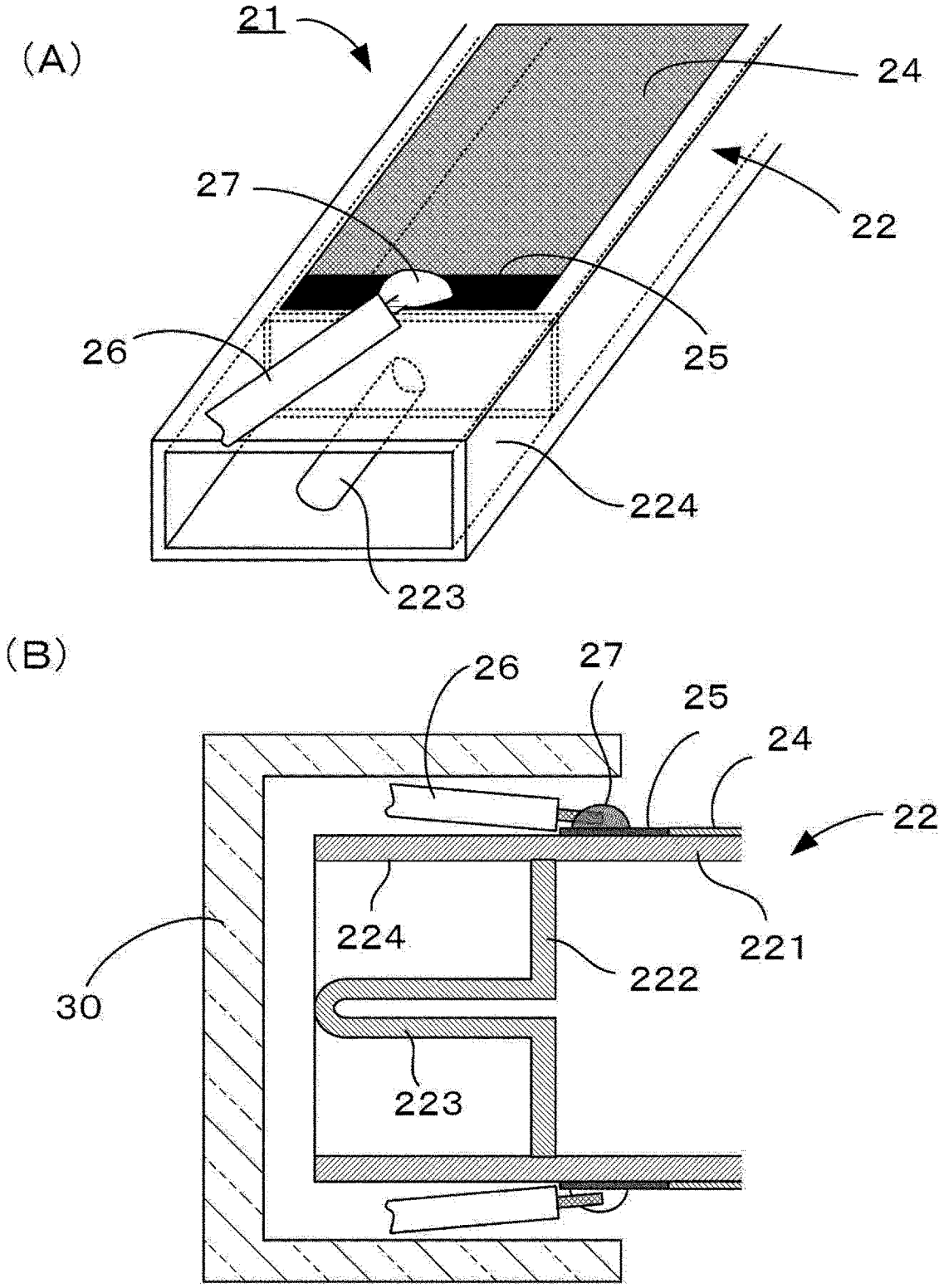
FIG. 6 is a perspective view (A) and a partially cross-sectional view (B) of a state where a lead is connected in a prior art example.
Figure 7:
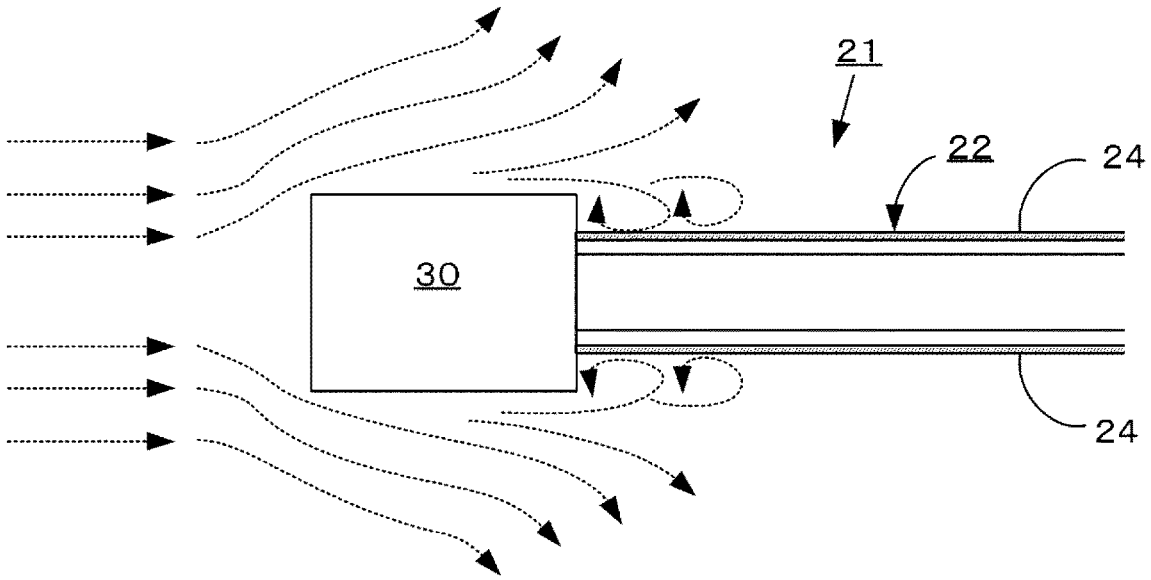
FIG. 7 is a diagram explaining a problem with a conventional excimer lamp.

FIG. 1 illustrates an excimer lamp 1 of the present invention, and FIG. 2 illustrates a state where a lead is connected. In FIG. 1 and FIG. 2, an exhaust tube (see FIG. 6) is omitted for the sake of avoiding complexity.

The excimer lamp 1 includes a discharge vessel 2 having a flat, substantially quadrilateral cross section and including a pair of quadrilateral plane face parts 3, 3 and a pair of side face parts 4, 4 extending along side edges in the longitudinal direction of the plane face parts. As illustrated in FIG. 1(B), a pair of external electrodes 5, 5 are provided on outer surfaces of the plane face parts 3, 3 of this discharge vessel 2. A discharge space inside the discharge vessel 2 is sealed and filled with a discharge gas that contains a rare gas and a chloride gas. The rare gas is selected from krypton, xenon, and so on.

The external electrodes 5, 5 may be formed on the outer surfaces of the plane face parts 3, 3 of the discharge vessel 2 by applying a metal paste such as gold paste, or by adhering a piece of transfer paper, for example. At least one of these external electrodes 5 is formed in a mesh form, for example, so as to have a light transmitting part. Ultraviolet generated in the discharge space is emitted through this light transmitting part.

A solid electrode 6 is formed at one end of the external electrode 5.

The cross-sectional shape of the discharge vessel 2 is not necessarily precisely a flat quadrilateral. Both or one of the plane face parts 3 and side face parts 4 may be slightly bulged outward, or concaved inward. Moreover, a trapezoidal shape or parallelogram may also be adopted. These shapes are herein collectively expressed as a substantially quadrilateral shape.

In this first embodiment, the discharge vessel 2 includes a tubular glass tube 2*a* having a substantially flat quadrilateral cross section, and sealing members 2*b* each welded to near an end portion of the glass tube. The end portion of the glass tube 2*a* protrudes out beyond the sealing member 2*b* to form a skirt part 2*c*. Concave parts 8, 8 are formed in this skirt part 2*c* in the direction in which the external electrodes 5 are oriented oppositely.

An auxiliary electrode 7 is connected to the external electrode 5 (solid electrode 6), and extends to the concave part 8.

This auxiliary electrode 7 may be formed by printing, or by applying a conductive paste using a dispenser followed by drying.

A lead 10 that supplies power to the external electrode 5 is connected to the auxiliary electrode 7 by welding with glass solder 11 or the like inside this concave part 8, as illustrated in FIG. 2. The glass solder 11 is preferably accommodated below the top of the concave part 8, i.e., below the plane face part 3.

When attaching a lamp base such as the one illustrated in FIG. 6(B) to the end portion of the discharge vessel 2 having the configuration described above, the weld (glass solder) 11 does not come in the way so that the thickness of the lamp base can be minimized.

Figure 3:
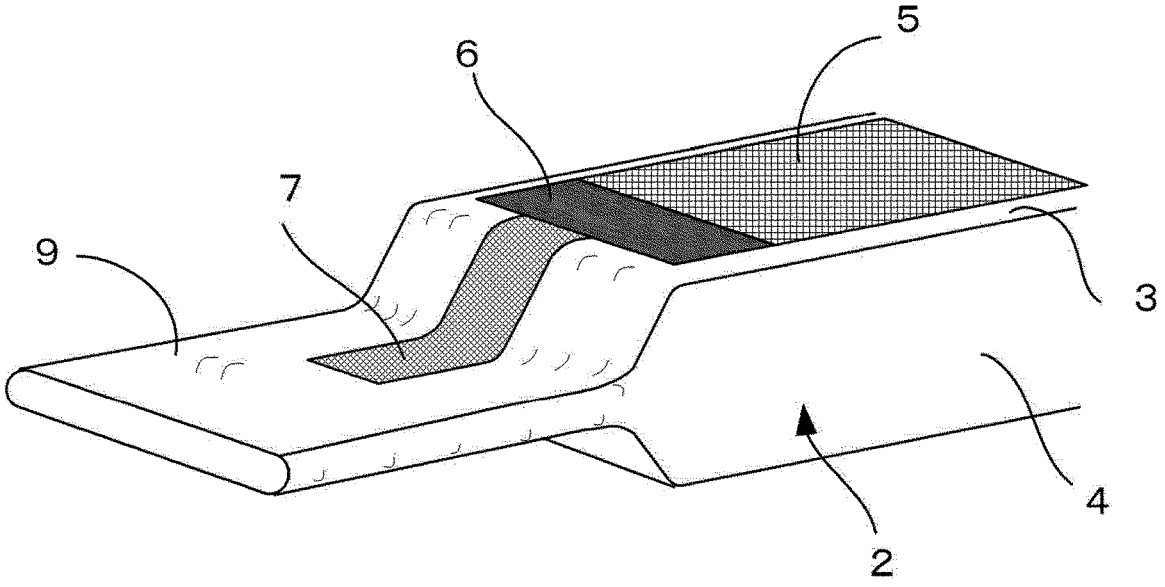
FIG. 3 is a perspective view of a second embodiment of the present invention.
Figure 4:
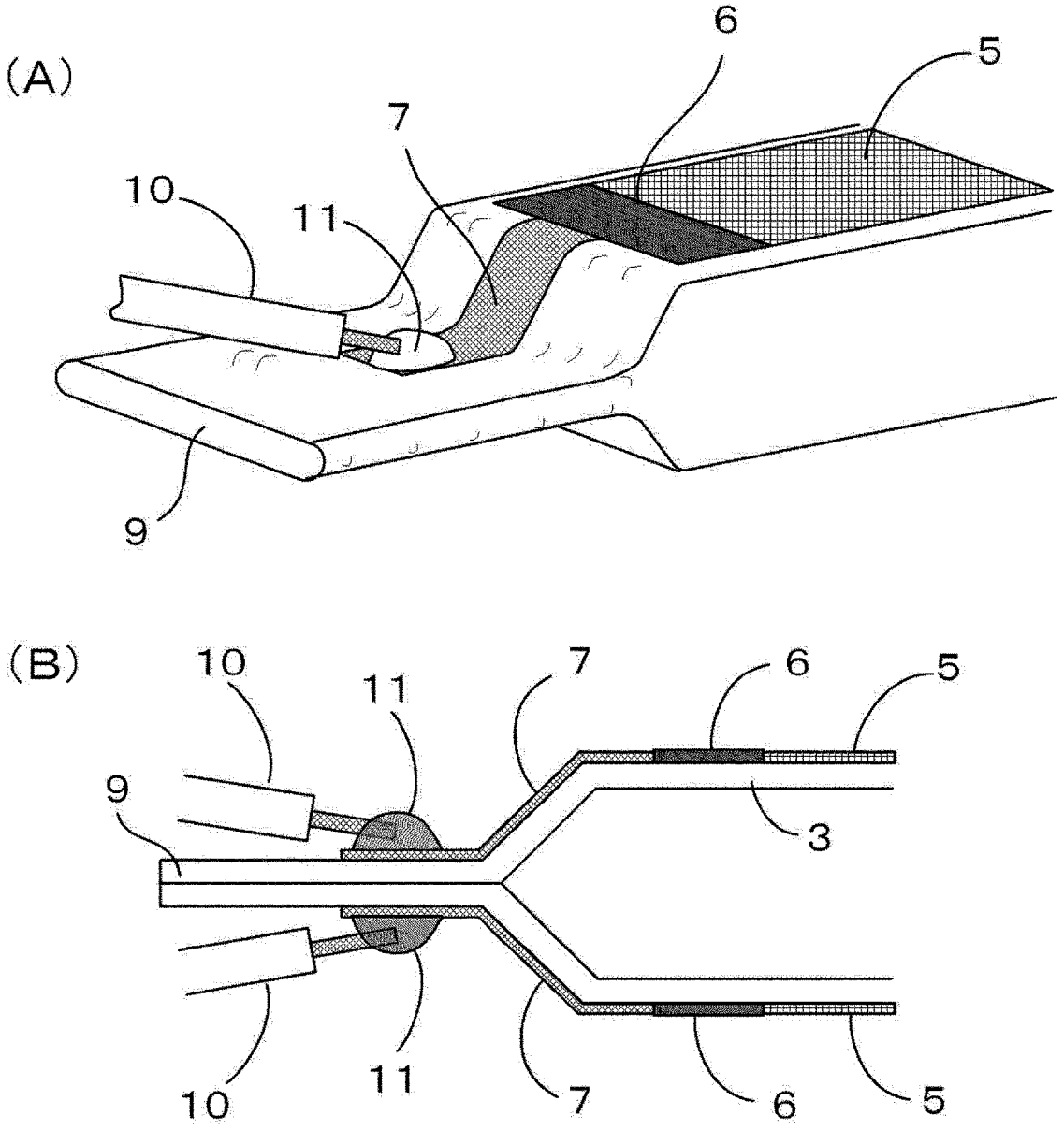
FIG. 4 is a perspective part (A) and a partially cross-sectional side view (B) of a state where a lead is connected.
Figure 5:
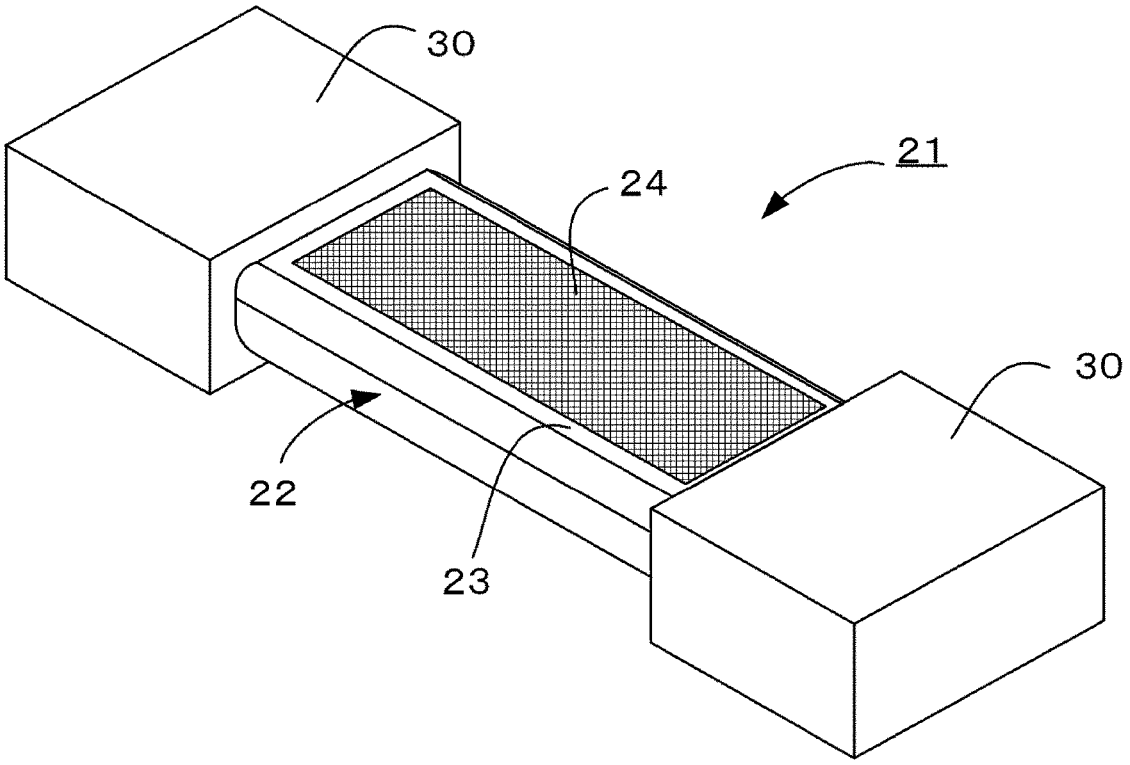
FIG. 5 is a perspective view of a conventional excimer lamp.

FIG. 3 and FIG. 4 illustrate a second embodiment, wherein a pinch seal part 9 is formed by crushing the plane face parts 3 flat in an end portion of the discharge vessel 2. The pinch seal part 9 is formed by heating the end portion of the discharge vessel 2 to soften, and by compressing and crushing the end portion, and this hermetically seals the discharge vessel 2.

The auxiliary electrode 7 is connected to the solid electrode 6 at the end of the external electrode 5 provided on the plane face part 3 of the discharge vessel 2. This auxiliary electrode 7 extends along the outer surface of the discharge vessel 2 to the pinch seal part 9.

FIGS. 4 (A) and (B) illustrate the connection structure of the lead 10 that supplies power to the external electrode 5. The lead 10 is connected to the auxiliary electrode 7 by welding with glass solder 11 or the like on the pinch seal part 9.

According to this embodiment, the lead 10 is welded to the auxiliary electrode 7 on the pinch seal part 9 so that the weld (glass solder) 11 does not protrude largely in the thickness direction between the plane face parts 3, 3 of the discharge vessel 2. In some cases, the glass solder may be accommodated within the thickness range, in which case the thickness of the lamp base (see FIG. 6(B)) to be attached to this end portion can be made smaller so that the thickness of the lamp base will not be much larger than the thickness between the plane face parts 3, 3.

While the auxiliary electrode 7 is illustrated as narrower than the external electrode 5 in this embodiment, the auxiliary electrode 7 need not necessarily be narrower, and may have the same width, for example, as the external electrode 5.

Moreover, the solid electrode 6, which is provided at the end of the external electrode 5 in the embodiment of FIG. 1 to FIG. 2 and in the embodiment of FIG. 3 to FIG. 4, may be omitted in an alternative structure.

As described above, according to the present invention, an auxiliary electrode is provided to an end portion of the external electrode that is provided on a plane face part of the discharge vessel, and a lead is connected to the auxiliary electrode in a region where the distance between the external electrodes is reduced. Therefore, the lead and its weld do not protrude from the plane face part largely in the thickness direction, which provides the effect of preventing the lamp base that covers the lead and weld from protruding more than the thickness of the discharge vessel as much as possible.

DESCRIPTION OF REFERENCE SIGNS

1: Excimer lamp
2: Discharge vessel
2*a*: Glass tube
2*b*: Sealing member
2*c*: Skirt part
3: Plane face part
4: Side face part
5: External electrode
6: Solid electrode
7: Auxiliary electrode
8: Concave part
9: Pinch seal part
10: Lead
11: Solder (weld)

The invention claimed is:

1. An excimer lamp comprising:

a discharge vessel including a pair of plane face parts and a pair of side face parts and having a flat, substantially quadrilateral cross section;

a pair of external electrodes each disposed on each of outer surfaces of the plane face parts of the discharge vessel;

an auxiliary electrode extending from an end portion of the external electrode to a specific area where a thickness of the discharge vessel is smaller than a distance between the plane face parts;

a lead connected to the auxiliary electrode in the specific area to supply power to the external electrode; and a light transmitting part equipped on at least one of the pair of external electrodes to pass through ultraviolet generated in the discharge vessel.

2. The excimer lamp according to claim 1, wherein the discharge vessel includes a glass tube having a flat, substantially quadrilateral cross section, and sealing members welded near an end portion of the glass tube, the glass tube includes a skirt part formed near the end portion of the glass tube with protruding out beyond the sealing member, and a concave part with a reduced thickness in the direction where the pair of external electrodes face each other, formed in a portion of the skirt part, the auxiliary electrode extends from the end portion of the external electrode to the concave part of the glass tube, and the lead is connected to the auxiliary electrode in the concave part of the glass tube.

3. The excimer lamp according to claim 1, wherein the discharge vessel includes a pinch seal part sealing the discharge vessel formed in an end portion of the discharge vessel, the auxiliary electrode extends from the end portion of the external electrode to the pinch seal part, and the lead is connected to the auxiliary electrode at the pinch seal part.

* * * * *